US011228116B1

(12) United States Patent
Wrigley

(10) Patent No.: US 11,228,116 B1
(45) Date of Patent: Jan. 18, 2022

(54) MULTI-BAND CIRCULARLY POLARIZED WAVEGUIDE FEED NETWORK

(71) Applicant: LOCKHEED MARTIN CORPORATION, Bethesda, MD (US)

(72) Inventor: Jason Stewart Wrigley, Littleton, CO (US)

(73) Assignee: Lockhead Martin Corporation, Bethesda, MD (US)

( * ) Notice: Subject to any disclaimer, the term of this patent is extended or adjusted under 35 U.S.C. 154(b) by 110 days.

(21) Appl. No.: 16/673,872

(22) Filed: Nov. 4, 2019

Related U.S. Application Data

(60) Provisional application No. 62/756,509, filed on Nov. 6, 2018.

(51) Int. Cl.

| | |
|---|---|
| ***H01Q 21/00*** | (2006.01) |
| ***H01Q 21/30*** | (2006.01) |
| ***H01P 1/207*** | (2006.01) |
| ***H01P 5/18*** | (2006.01) |
| ***H01P 11/00*** | (2006.01) |
| ***H01P 5/20*** | (2006.01) |

(52) U.S. Cl.
CPC ..... *H01Q 21/0087* (2013.01); *H01P 1/207* (2013.01); *H01P 5/181* (2013.01); *H01P 5/20* (2013.01); *H01P 11/002* (2013.01); *H01P 11/007* (2013.01); *H01Q 21/0025* (2013.01); *H01Q 21/0037* (2013.01); *H01Q 21/30* (2013.01)

(58) Field of Classification Search
CPC ..... H01Q 21/0087; H01Q 21/0025; H01Q 21/0037; H01Q 21/30; H01Q 13/0258; H01P 1/207; H01P 11/002; H01P 11/007; H01P 5/20; H01P 5/181; H01P 1/161; H01P 1/17
See application file for complete search history.

(56) References Cited

U.S. PATENT DOCUMENTS 3,445,853 A * 5/1969 Leonard ..... H01Q 3/26 342/361
4,302,733 A * 11/1981 Salzberg ..... H01P 5/16 333/101
5,329,285 A * 7/1994 McCandless ..... G01S 7/024 333/115
5,506,589 A * 4/1996 Quan ..... H01Q 21/0075 342/154
5,557,291 A * 9/1996 Chu ..... H01Q 13/085 343/725

(Continued)

*Primary Examiner* — Dimary S Lopez Cruz
*Assistant Examiner* — Bamidele A Jegede
(74) *Attorney, Agent, or Firm* — Morgan, Lewis & Bockius LLP

(57) ABSTRACT

A multiband waveguide feed network includes multiple transmit (TX) magic tees, multiple receive (RX)-reject waveguide filters configured to reject RX frequencies, and multiple branch-line couplers configured to couple the plurality of RX-reject waveguide filters to the plurality of TX magic tees. The multiband waveguide feed network includes a quadrature junction coupler configured to couple the plurality of RX-reject waveguide filters to an antenna port. The multiband waveguide feed network is configured to be fabricated in four pieces with three split planes, and the multiband waveguide feed network is circularly polarized.

20 Claims, 17 Drawing Sheets

(56) References Cited

U.S. PATENT DOCUMENTS 6,201,508 B1 * 3/2001 Metzen ..... H01Q 13/0258 343/776
6,504,514 B1 * 1/2003 Toland ..... H01Q 1/288 343/781 P
7,408,427 B1 * 8/2008 Lee-Yow ..... H01P 1/161 333/126
7,821,355 B2 * 10/2010 Engel ..... H01P 1/2138 333/117
8,816,930 B2 * 8/2014 Fonseca ..... H01P 1/161 343/850
9,142,872 B1 * 9/2015 Izadian ..... H01P 5/20
9,748,623 B1 * 8/2017 Lee-Yow ..... H01P 1/161
2004/0036661 A1 * 2/2004 Hanlin ..... H01Q 23/00 343/786
2006/0226931 A1 * 10/2006 Tavassoli Hozouri ..... H01P 1/161 333/117
2009/0309801 A1 * 12/2009 Rao ..... H01Q 1/288 343/779
2010/0007432 A1 * 1/2010 Uher ..... H01P 1/161 333/132
2010/0149058 A1 * 6/2010 Bosshard ..... H01P 1/2131 343/756
2010/0259339 A1 * 10/2010 Corman ..... G06G 7/12 333/117
2011/0260807 A1 * 10/2011 Montero Ruiz ..... H01P 1/161 333/117
2013/0201070 A1 * 8/2013 Parsche ..... H01Q 13/0258 343/786
2013/0342282 A1 * 12/2013 Uher ..... H01P 1/2131 333/135
2015/0207201 A1 * 7/2015 Kohl ..... H01P 1/161 333/254
2016/0134004 A1 * 5/2016 Haluba ..... H01Q 13/02 455/12.1
2016/0218438 A1 * 7/2016 Miraftab ..... H01Q 21/0037
2017/0077610 A1 * 3/2017 Bongard ..... H01Q 21/24

* cited by examiner

700B

700A

700C

800D

800C

MULTI-BAND CIRCULARLY POLARIZED WAVEGUIDE FEED NETWORK

CROSS-REFERENCE TO RELATED APPLICATIONS

This application claims the benefit of priority under 35 U.S.C. § 119 from U.S. Provisional Patent Application 62/756,509 filed Nov. 6, 2018, which is incorporated herein by reference in its entirety.

STATEMENT REGARDING FEDERALLY SPONSORED RESEARCH OR DEVELOPMENT

Not applicable.

FIELD OF THE INVENTION

The present invention generally relates to waveguide feeds, and more particularly to a multi-band circularly polarized waveguide feed network.

BACKGROUND

Typically, antenna waveguide feed networks which cover wide bandwidths such as the commercial Ka Band, are composed of many parts, have a high level of complexity and high mass. The numerous parts and high level of complexity can also lead to manufacturing risks, which can further increase the costs of manufacturing over the commercial Ka band.

SUMMARY

According to various aspects of the subject technology, methods and configuration are disclosed for providing low-cost and compact Ka-band circular polarization waveguides with dual polarization transmit (TX) and dual polarization receive (RX).

In one or more aspects, a multiband waveguide feed network includes multiple TX magic tees, multiple RX-reject waveguide filters configured to reject RX frequencies, and multiple branch-line couplers configured to couple the plurality of RX-reject waveguide filters to the plurality of TX magic tees. The multiband waveguide feed network further includes a quadrature junction coupler configured to couple the plurality of RX-reject waveguide filters to an antenna port. The multiband waveguide feed network is configured to be fabricated in four pieces with three split planes and is circularly polarized.

In other aspects, an antenna array system includes an antenna array consisting of multiple antenna elements and an array of multiband waveguide feed networks consisting of multiple multiband waveguide feed networks. Each multiband waveguide feed network is coupled to an antenna element of the antenna array, and includes multiple TX magic tees, multiple RX-reject waveguide filters configured to reject RX frequencies, multiple branch-line couplers configured to couple the multiple RX-reject waveguide filters to the multiple TX magic tees, and a quadrature junction coupler configured to couple the multiple RX-reject waveguide filters to an antenna port. Each multiband waveguide feed network is configured to be fabricated in four pieces with three split planes, and the multiband waveguide feed network is circularly polarized.

In yet other aspects, a circularly polarized multiband waveguide feed network device includes a first section, a second section coupled to the first section via a first split-plane, a third section coupled to the second section via a second split-plane, and a fourth section coupled to the third section via a third split-plane. The circularly polarized multiband waveguide feed network device further includes multiple TX magic tees, multiple RX-reject waveguide filters configured to reject RX frequencies, multiple branch-line couplers configured to couple the multiple RX-reject waveguide filters to the multiple TX magic tees. The circularly polarized multiband waveguide feed network device further includes a TX magic tee of the multiple TX magic tees implemented as a first portion and a second portion in the first section and the second section, respectively. The first, second, and third split-planes are on zero-current region of the device.

The foregoing has outlined rather broadly the features of the present disclosure so that the following detailed description can be better understood. Additional features and advantages of the disclosure, which form the subject of the claims, will be described hereinafter.

BRIEF DESCRIPTION OF THE DRAWINGS

For a more complete understanding of the present disclosure, and the advantages thereof, reference is now made to the following descriptions to be taken in conjunction with the accompanying drawings describing specific aspects of the disclosure, wherein.

DETAILED DESCRIPTION

Figure 1:
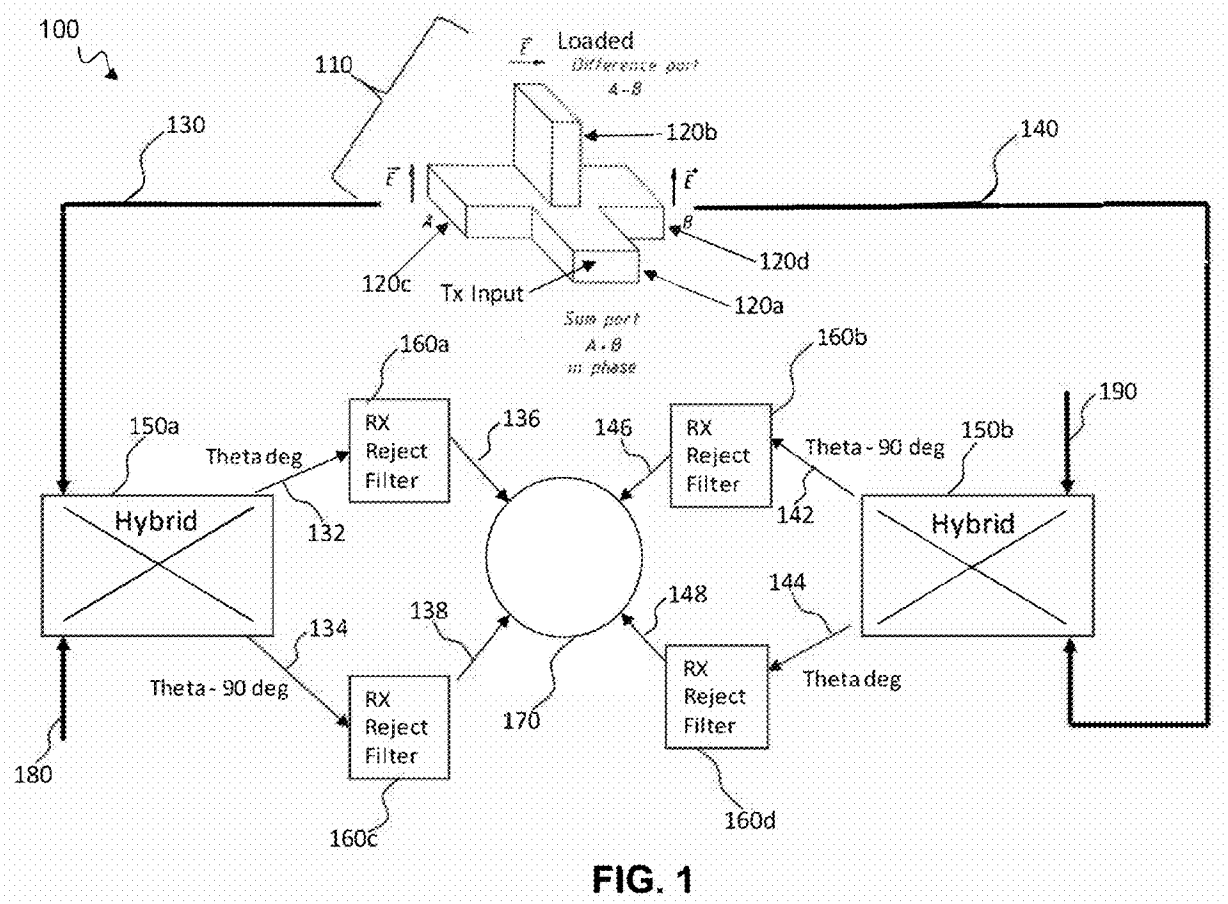
FIG. 1 is a conceptual diagram illustrating an example of one polarization of the TX portion of a multiband circularly polarized waveguide feed network, according to certain aspects of the disclosure.

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and can be practiced using one or more implementations. In one or more instances, well-known structures and components are shown in block-diagram form in order to avoid obscuring the concepts of the subject technology.

Methods and configurations are described for providing a low-cost and compact Ka-band circular polarization waveguides. The subject technology provides for a high performance, low mass and low cost waveguide feed network solution for extended multi-bands, including Ka band. The commercial Ka band can be defined as: TX: 17.700 GHz to 20.200 GHz and RX: 27.5 GHz to 30.00 GHz. The waveguide feed can be readily scaled to any frequency band beyond the Ka band, which requires narrowband operation with proper TX to RX frequency separation. In some aspects, the waveguide feed solution can be scaled for C-Band or others. The subject technology provides for a multi-band waveguide solution with circularly polarized power splitters covering narrowband operation including the Ka Band based on the positioning of the components within the split planes as well as the split plane selection. It is this positioning and selection that leads to significant mass and complexity reductions as well as manufacturing risk mitigation.

In particular, the subject technology relates to microwave circular polarization waveguides with dual polarization transmit (TX) in the Ka-band (e.g., 17.70 to 20.20 GHz) and dual polarization receive (RX) in the Ka-band (e.g., 27.50 to 30.00 GHz) of the electromagnetic spectrum. In one or more implementations, the circularly polarized waveguide feed network of the subject technology can be a waveguide with four sections with split planes on the zero-current region. In one or more implementations, the feed can be desirably fit under the smallest aperture sizes for array configurations.

In one or more implementations, by utilizing two branch-line couplers rather than just one, the subject technology allows for the entire waveguide feed network to be split on the zero current region, and maintain symmetry and mitigate manufacturing risk. In one or more implementations, the use of two branch-line couplers allows for simple routing of waveguides to different magic tees and without degrading axial ratio of the waveguide feed network. In one or more implementations, positioning of the magic tees in same split-planes as other components (e.g., RX network, antenna port) of the waveguide feed network allows for significant miniaturization, mass reduction, and manufacturing risk reduction. In one or more implementations, by utilizing magic tees with the difference ports loaded, risk of recombination path length mismatch is mitigated and the recombination paths do not require tuning.

Existing solutions are typically at a much higher level of complexity (e.g., multipart multi-component assembly) and costs. The disclosed waveguide can be made of four pieces and/or sections at a fraction of the cost of the traditional approach.

For the purposes of the present disclosure TX is the lower operating band and RX is the higher operating band. However, the TX and RX nomenclature here could be reversed as would be typical of a ground antenna rather than a space antenna.

FIG. 1 is a conceptual diagram illustrating an example of one polarization of a TX portion of a multiband circularly polarized waveguide feed network 100, according to certain aspects of the disclosure. The multiband circularly polarized waveguide feed network 100 includes a magic tee 110 (also referred to as a "hybrid tee"), branch-line couplers (also referred to as "hybrid couplers" and/or "E-plane couplers") 150*a*, 150*b*, collectively referred to as branch-line couplers 150, RX-reject waveguide filters 160*a*, 160*b*, 160*c*, 160*d*, collectively referred to as RX-reject waveguide filters 160, and a quadrature junction coupler (QJC) 170. The magic tee 110 is an electric-field and a magnetic-field 3-dB coupler. The magic tee 110 includes four ports, 120*a*, 120*b*, 120*c*, 120*d*. Port 120*a* is a sum port, port 120*b* is a difference port, and ports 120*c* and 120*d* are co-linear ports. The sum port 120*a* can be configured to be a TX port and the difference port 120*b* can be configured to be a loaded port. Branch-line coupler 150*a* is coupled to the co-linear port 120*c* via TX recombination-path waveguide 130, and branch-line coupler 150*b* is coupled to the co-linear port 120*d* via TX recombination-path waveguide 140. The branch-line coupler 150*a* and 150*b* are coupled to another magic tee (not shown in FIG. 1) of the multiband circularly polarized waveguide feed network 100 via other waveguides (not shown in FIG. 1) RX-reject waveguide filters 160*a* and 160*b* are coupled to the branch-line coupler 150*a* via waveguides 132, 134, and RX-reject waveguide filters 160*c* and 160*d* are coupled to the branch-line coupler 150*b* via waveguides 142, 144. QJC 170 can be a circular waveguide that couples RX-reject waveguide filters 160 to an antenna (e.g., horn antenna) port.

The magic tee 110 splits a full-power TX signal to the sum port 120*a* between the co-linear ports 120*c* and 120*d* at phase equal to zero. For example, the magic tee 110 splits the full-power TX signal equally into two half-power TX signals at phase equal to zero between the co-linear ports 120*c* and 120*d*. The branch-line coupler 150*a* further splits the received TX signal (e.g., half-power TX signal at phase equal to zero) via waveguide 130 into two TX signals (e.g., two quarter-power signals) with one of the signals at phase equal to zero and the other signal with a phase of 90 degrees. Similarly, the branch-line coupler 150*b* further splits the received TX signal (e.g., half-power TX signal at phase equal to zero) via waveguide 140 into two TX signals (e.g., two quarter-power signals) with one of the signals at phase equal to zero and the other signal with a phase of 90 degrees. The split signal at phase equal to zero from the branch-line coupler 150*a* is co-polar to the split signal at phase equal to zero from the branch-line coupler 150*b*. Similarly, the split signal with phase of 90 degrees is co-polar with the split signal with phase of 90 degrees from the branch-line coupler 150*b*.

The split signals from branch-line coupler 150*a* are fed to the RX-reject waveguide filters 160*a* and 160*b* via waveguides 132 and 134, respectively, and the split-signals from branch-line coupler 150*b* are provided to the RX-reject waveguide filters 160*c* and 160*d* via waveguides 142 and 144. The RX-reject waveguide filters 160*a*, 160*b*, 160*c*, and 160*d*, are configured to reject RX frequencies (e.g., frequencies within a range of 27-30 GHz) and feed the TX signals received via waveguides 132, 134, 142, and 144 to the QJC 170 via waveguides 136, 138, 146, and 148, respectively. The split signals via waveguides 136, 138, 146, 148 meet the QJC 170 in a co-polar orientation and the QJC 170 is configured to recombine the split signals received via waveguides 136, 138, 146, 148 to form a full power TX signal. Due to each split TX signal fed to the QJC 170 being co-polar with at least one other split TX signal fed to the QJC 170, the split TX signals can be recombined to form the full power TX signal, which is now circularly polarized and is emitted from the antenna port.

The use of two branch-line couplers 150 by the subject technology overcomes the manufacturing hurdles facing the existing solution and allows for fabrication of the multiband circularly polarized waveguide feed network 100 in four pieces with three zero-current split planes. Additionally, the use of two branch-line couplers 150 allows for mating of two magic tees and allows for dual polarization transmit (TX) and dual polarization receive (RX). In one or more implementations, the multiband circularly polarized waveguide feed network 100 of the subject technology can be fabricated using a suitable material such as aluminum or other material, for example, by machining, electroplating, and/or other fabrication techniques. In one or more implementations, multiband circularly polarized waveguide feed network 100 can be fabricated using a three-dimensional (3-D) printing and/or other similar fabrication techniques. The polarization of the TX portion depicted in FIG. 1 may be either right-handed circularly polarized (RHCP) or left-handed circularly polarized (LHCP). The other polarization, being either LHCP or RHCP, of the TX portion of the multiband circularly polarized waveguide feed network 100 can also be realized similarly via the components described herein with reference to FIG. 1.

Figure 2B:
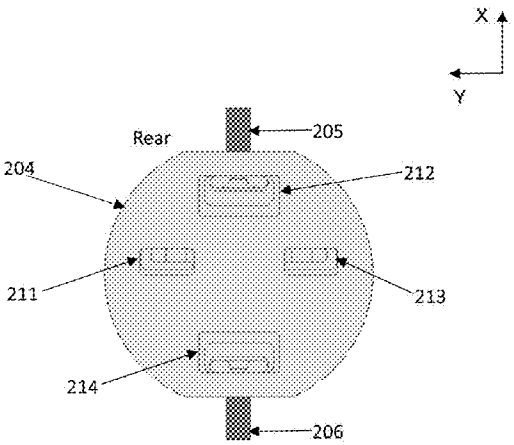
FIGS. 2A, 2B, 2C, and 2D are schematic diagrams illustrating various views of shelled and air-cavity models of an example multiband circularly polarized waveguide feed network, according to certain aspects of the disclosure.
Figure 2A:
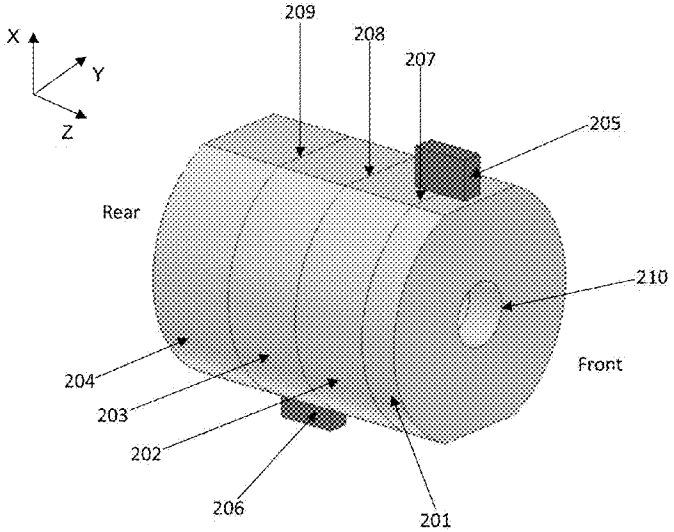

FIGS. 2A, 2B, 2C, and 2D are diagrams illustrating various views of shelled models and air cavity models of an example multiband circularly polarized waveguide feed network, according to certain aspects of the disclosure. FIG. 2A is a perspective view of a shelled model 200A of an example multiband circularly polarized waveguide feed network (e.g., multiband circularly polarized waveguide feed network 100 of FIG. 1). The three dimensional (3-D) axis shown in FIG. 1 indicates the orientation of the shelled model 200A. The shelled model 200A is a fabrication model and includes four pieces, a first piece 201, a second piece 202, a third piece 203, and a fourth piece 204, which are joined together to collectively perform the functionalities of multiband circularly polarized waveguide feed network 100. The first piece 201 and the second piece 202 are joined at split plane 207, the second piece 202 and the third piece 203 are joined at split plane 208, and the third piece 203 and the fourth piece 204 are joined at split plane 209. The split planes 207, 208, and 209 are zero-current split planes and they split the waveguides through two pieces down the center of the waveguides in the zero current region. For example, the split plane 207 splits the waveguides between the first piece 201 and the second piece 202 down the center of those waveguides in the zero current region. Similarly, the split planes 208 and 209 split the waveguides between pieces 202 and 203, and pieces 203 and 204, respectively, down the center of those waveguides in the corresponding zero current regions.

The shelled model 200A shows a loaded difference port 205 of a magic tee placed across the first piece 201 and the second piece 202, and a loaded difference port 206 of a magic tee placed across the third piece 203 and fourth piece 204. The shelled model 200A shows an antenna port 210 that can be coupled to a radio-frequency (RF) antenna. Additional details of the shelled model 200A and various components of the shelled model 100 are described herein with respect to FIGS. 2B-8.

FIG. 2B shows a rear-view 200B of the shelled model 200A. The rear-view 200B shows a rear-side of the piece 204, two rectangular TX waveguide ports 212 and 214, two rectangular RX waveguide ports 211 and 213, and the loaded difference ports 205 and 206 of magic tees. The TX waveguide ports 212 and 214 are coupled to the sum ports of the magic tees. For example, the TX waveguide port 212 is coupled to the sum port of the magic tee with the loaded difference port 205, and the TX waveguide port 214 is coupled to the sum port of the magic tee with the loaded difference port 206. In one or more implementations, one of the TX waveguide ports (e.g., TX waveguide port 212) may transmit a left-handed circularly polarized (LHCP) signal and one of the TX waveguide ports (e.g., TX waveguide port 214) may transmit a right-handed circularly polarized (RHCP) signal.

In one or more implementations, one of the RX waveguide ports (e.g., RX waveguide port 211) may receive left-handed circularly polarized (LHCP) signal and one of the RX waveguide ports (e.g., RX waveguide port 213) may receive a right-handed circularly polarized (RHCP) signal. The multiband circularly polarized waveguide feed network 100 as described herein is configured to transmit signals while maintaining sufficient isolation from the receive band, and receive signals while maintaining sufficient isolation from the transmit band.

Figure 2C:
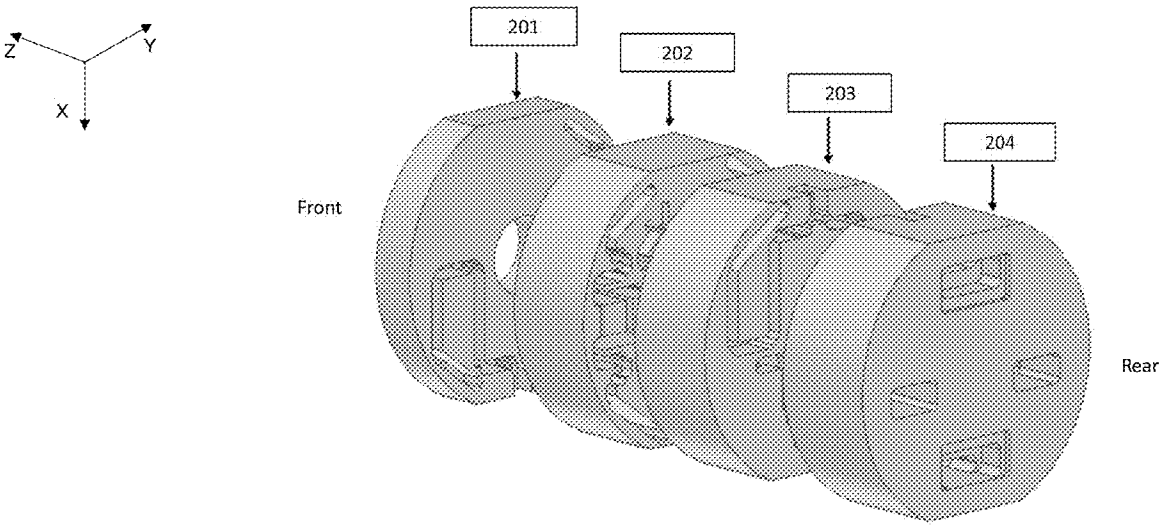
Figure 2D:
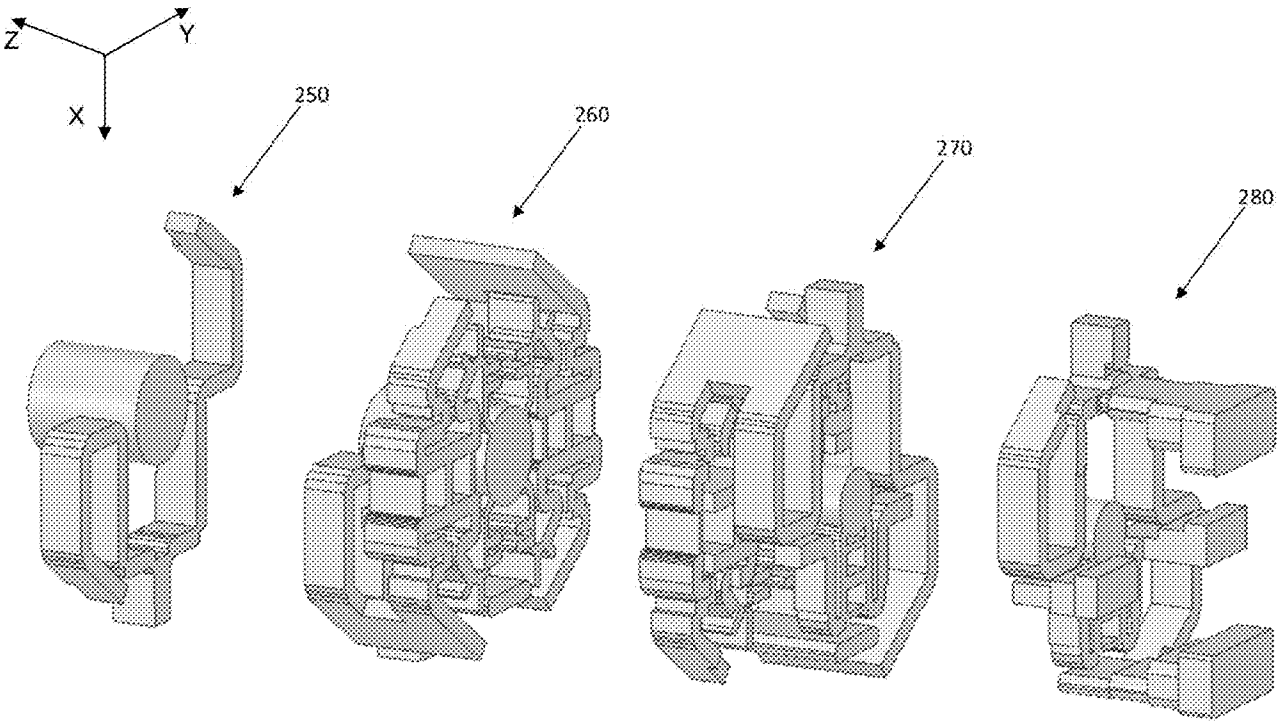

FIG. 2C shows an exploded perspective view of the shelled model 200A. The perspective view shown in FIG. 2C is from a different angel than the one shown in FIG. 2A to reveal the wave cavities on the rear side of the pieces 201, 202, 203, and 204. The pieces 201, 202, 203, 204 form a continuous internal wave cavity creating the multiband circularly polarized waveguide feed network described herein. FIG. 2D shows the perspective view of the air cavity models 250, 260, 270, and 280 of pieces 201, 202, 203, and 204, respectively. More structural details of the pieces 201, 202, 203, and 204 are discussed below.

Figure 3B:
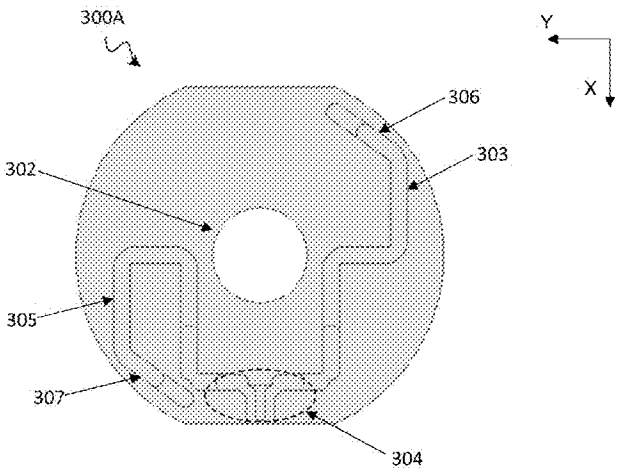
FIGS. 3A, 3B, 3C, 3D, 3E, 3F, 3G, and 3H are schematic diagrams illustrating various piecewise views of shelled models of an example multiband circularly polarized waveguide feed network, according to certain aspects of the disclosure.
Figure 3A:
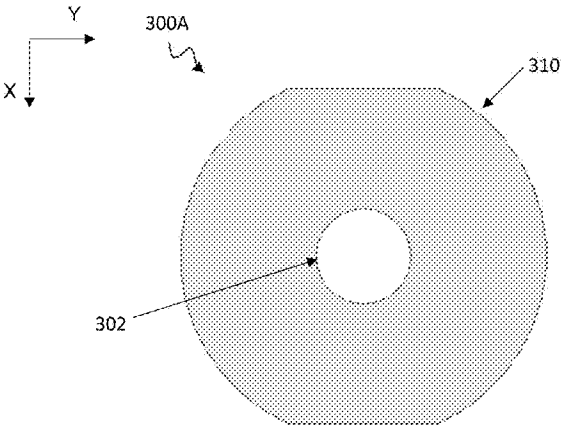

FIGS. 3A, 3B, 3C, 3D, 3E, 3F, 3G, and 3H are schematic diagrams illustrating various views of shelled models of an example multiband circularly polarized waveguide feed network, according to certain aspects of the disclosure. FIG. 3A shows a front view of a shelled model 300A of piece 310. Piece 310 is the same as the piece 201 of FIG. 2A. The shelled model 300A shows the antenna port 302. The antenna port 302 is the same as the antenna port 210 of FIG. 2A. The antenna port 302 mates to a radio-frequency (RF) antenna (not shown for simplicity) to propagate TX signals and receive RX signals. FIG. 3B shows a rear view of the shelled model 300A of piece 310. The shelled model 300A is a fabrication model and shows a first portion of the LHCP TX recombination-path waveguides 303 and 305, and a first portion of the magic tee 304.

The LHCP TX recombination-path waveguides 303 and 305 are coupled to the co-planar ports of the magic tee 304. The LHCP TX recombination-path waveguides 303 and 305 route the TX signals symmetrically to a TX branch-line coupler (shown in FIGS. 3E and 3F). The LHCP Hbends 306 and 307 are folded back to the TX branch-line coupler. The LHCP TX recombination-path waveguides 303 and 305. The LHCP TX recombination-path waveguide 303 is identical to the LHCP TX recombination-path waveguide 305 but clocked differently from the each other. The path lengths of the LHCP TX recombination-path waveguide 303 and 305 are identical, which may prevent any energy mismatch when the split signals are later recombined at a TX manifold (shown in FIG. 3D). The shelled model 300A of piece 310 comprises a first half of the LHCP TX recombination-path waveguides 303 and 305, with the other half of the TX recombination-path waveguides 303 and 305 fabricated in the shelled model of a second piece 302, as shown in FIG. 3C.

Figures 3C, 3D:
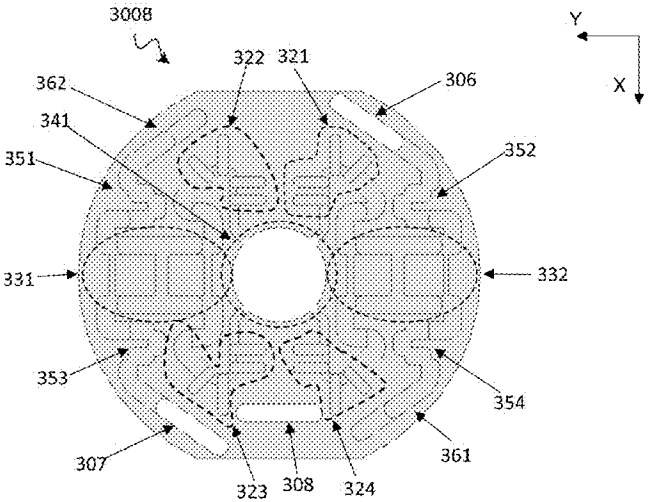

FIG. 3C shows a front view of a shelled model 300B of piece 320. Piece 320 is the same as the piece 202 of FIG. 2A. The shelled model 300B is a fabrication model and shows the second portions of the LHCP TX recombination-path waveguides 303 and 305, the second portion of the magic tee 304 and a first portion of the LHCP TX sum port 308 of the magic tee 304. FIG. 3D shows a rear view of the shelled model 300B of piece 320. The shelled model 300B shows first portions of the RX-reject waveguide filters 321, 322, 323, 324, first portions of TX branch-line couplers 331 and 332, first portions of transverse-electric (TE)20 suppression bends 351, 352, 353, 354, third portions of the LHCP Hbends 306 and 307, first portions of the RHCP Hbends 361 and 362, a second portion of LHCP TX sum port 308 of the magic tee 304, and the TX manifold 341. The TE20 suppression bends 352 and 353 are coupled to the LHCP Hbends 306 and 307. The TE20 suppression bends 351 and 354 are coupled to the RHCP Hbends 361 and 362.

The TE20 suppression bends 351, 352, 353, and 354 provide broadband isolation from TE20 mode. The TE20 suppression bends 351, 353 suppress the TE20 mode generated by the LHCP Hbends 306 and 307, respectively, and the TE20 suppressions bends 352 and 354 suppress the TE20 mode generated by the RHCP Hbends 361 and 362, respectively. The RHCP Hbends are folded backwards and are coupled to the RHCP TX recombination-path waveguides described in detail below. The TE20 suppression bends 351 and 353 are coupled to the input ports of branch-line coupler 331 and the TE20 suppression bends 352 and 354 are coupled to the input ports of branch-line coupler 332.

Each of the branch-line couplers 331 and 332 can comprise four ports, two input ports and two output ports. The branch-line couplers 331 and 332 are similarly configured as branch-line couplers 150*a* and 150*b* (shown in FIG. 1), split the received LHCP and RHCP signals, and create a 90 degree phase shift to generate circular polarization at the TX manifold 341. In one or more implementations, an input port of the branch-line couplers 331 and 332 may be a 6-dB port with a phase of zero degrees and another input port of the branch-line couplers 331 and 332 may be a 6-dB port with a phase of 90 degrees. The output ports of the branch-line coupler 331 are coupled to the RX-reject waveguide filters 321 and 323, and the output ports of the branch-line coupler 332 are coupled to the RX-reject waveguide filters 322 and 324.

The branch-line couplers 331 and 332 are coupled to the TX manifold 241 via the RX-reject waveguide filters 321, 322, 323, 324. The RX-reject waveguide filters 321, 322, 323, 324 are similarly configured as reject RX-reject waveguide filters 160*a*, 160*b*, 160*c*, and 160*d*, and reject RX frequencies (e.g., within a range of about 27-30 GHz). The RX-reject waveguide filters 321, 322, 323, 324 prevent RX signals from entering the TX network and allow them to pass straight through. The TX manifold 341 is configured to combine the TX signals to generate circular polarization.

Figure 3F:
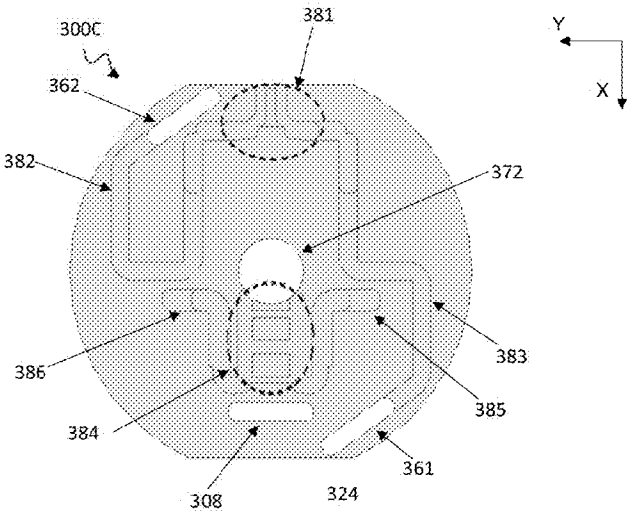
Figure 3E:
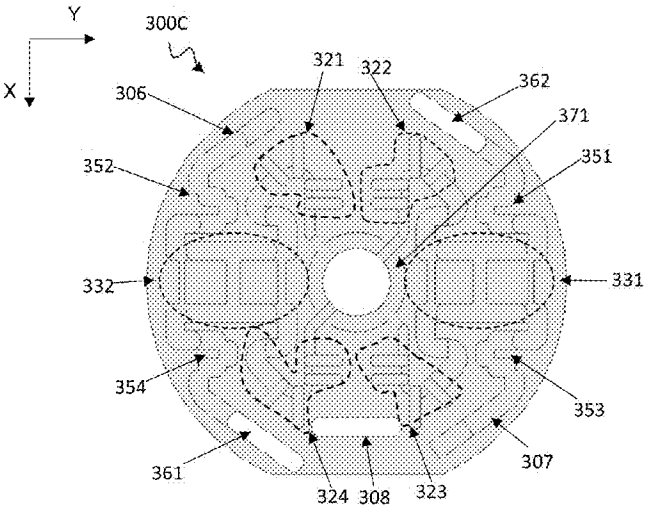

FIG. 3E shows a front view of the shelled model 300C of piece 330. Piece 330 is the same as the piece 203 of FIG. 2A. The shelled model 300B is a fabrication model and shows the second portions of the RX-reject waveguide filters 321, 322, 323, 324, second portions of TX branch-line couplers 331 and 332, second portions of transverse-electric (TE)20 suppression bends 351, 352, 353, 354, fourth portions of the LHCP Hbends 306 and 307, second portions of the RHCP Hbends 361 and 362, a third portion of LHCP TX sum port 308 of the magic tee 304, and TX reject filter 371. The TX reject filter 371 comprises as a circular waveguide as shown in FIG. 3E. The TX reject filter 371 has a cutoff over the TX frequencies (e.g., within a range of about 17-20 GHz). The TX reject filter 371 is configured such that the dominant TE11 mode is in the cutoff, and allows for free propagation of the RX signals, particularly in the TE11 mode.

FIG. 3F shows the rear view of the shelled model 300C of piece 330. In FIG. 3C, the shelled model 300C shows a first portion of the magic tee 381, a first portion of the RHCP TX recombination-path waveguides 382 and 383, third portions of the RHCP Hbends 361 and 362, a first portion of an RX branch-line coupler 384, a first portion of the RX Hbends 385 and 386, RX manifold 372, and fourth portion of LHCP TX sum port 308 of the magic tee 304. The RX branch-line coupler 384 is coupled to the RX manifold 372, and the RX branch-line coupler 384 splits the RX signal received via the RX manifold 372. The split RX signals may be phase shifted by 90 degrees. The RX branch-line coupler 384 may be configured to split the RX signal equally (e.g., each split signal with half the power of the received RX signal). The RX branch-line coupler may be coupled to the RX Hbends 385 and 386. The RX Hbends 385 and 386 are configured to route the split RX signals to the rear of the assembly of a multiband circularly polarized waveguide feed network.

The magic tee 381 splits a TX signal received at a sum port of the magic tee 381, and provides the split signals to the branch-line couplers 331 and 332 via the RHCP TX recombination-path waveguides 382 and 383. The RHCP TX recombination-path waveguides 382 and 383 are coupled to the co-planar ports of the magic tee 381. The RHCP TX recombination-path waveguides 382 and 383 route the split signals from the magic tee 381 to the branch line couplers 331 and 332 via the RHCP Hbends 361 and 362.

Figure 3H:
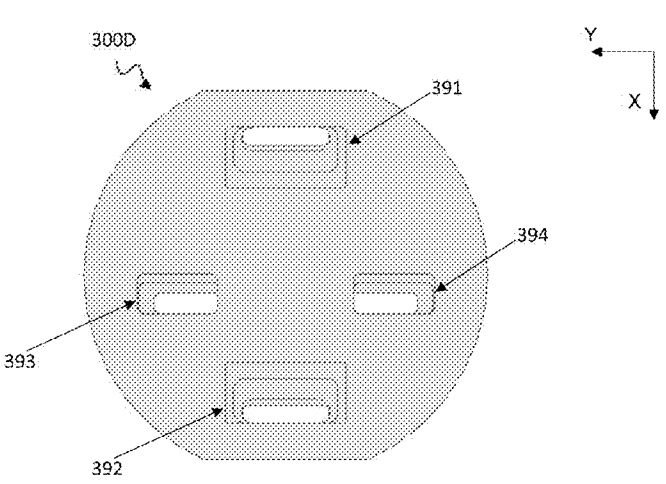
Figure 3G:
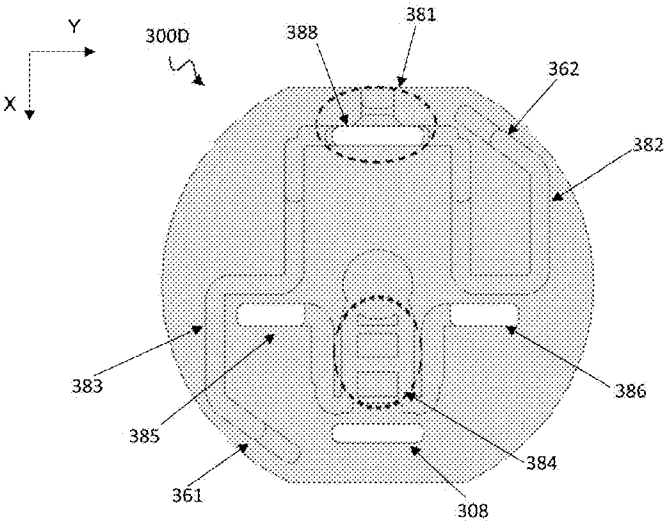

FIG. 3G shows a front view of the shelled model 300D of piece 340. Piece 340 is the same as the piece 204 of FIG. 2A. In FIG. 3G, the shelled model 300D shows the second portion of the magic tee 381, a RHCP TX sum port 388 of the magic tee 381, a second portion of the RHCP TX recombination-path waveguides 382 and 383, fourth portions of the RHCP Hbends 361 and 362, a second portion of an RX branch-line coupler 384, a second portion of the RX Hbends 385 and 386, a second portion of the RX manifold 372, and fifth portion of LHCP TX sum port 308 of the magic tee 304. The RX Hbends 385 and 386 are coupled to RX transformers (shown in FIG. 3H) to transform the signals to standard waveguide size.

FIG. 3H shows a rear view of the shelled model 300D of piece 340. In FIG. 3H, the shelled model 300D shows RHCP TX waveguide transformer 391, LHCP TX waveguide transformer 392, RHCP RX waveguide transformer 393, and LHCP RX waveguide transformer 394. The RHCP TX waveguide transformer 391 is coupled to the sum port 388 of the magic tee 381, and provide an input TX signal to the magic tee 381. The LHCP TX waveguide transformer 392 is coupled to the LHCP TX sum port 308 of the magic tee 304, and provide an input TX signal to the magic tee 304. The RHCP RX waveguide transformer 393 is coupled to the RX branch-line coupler 384 via the RX Hbend 385 and the LHCP RX waveguide transformer 394 is coupled to the RX branch-line coupler 384 via the RX Hbend 386.

Figure 4:
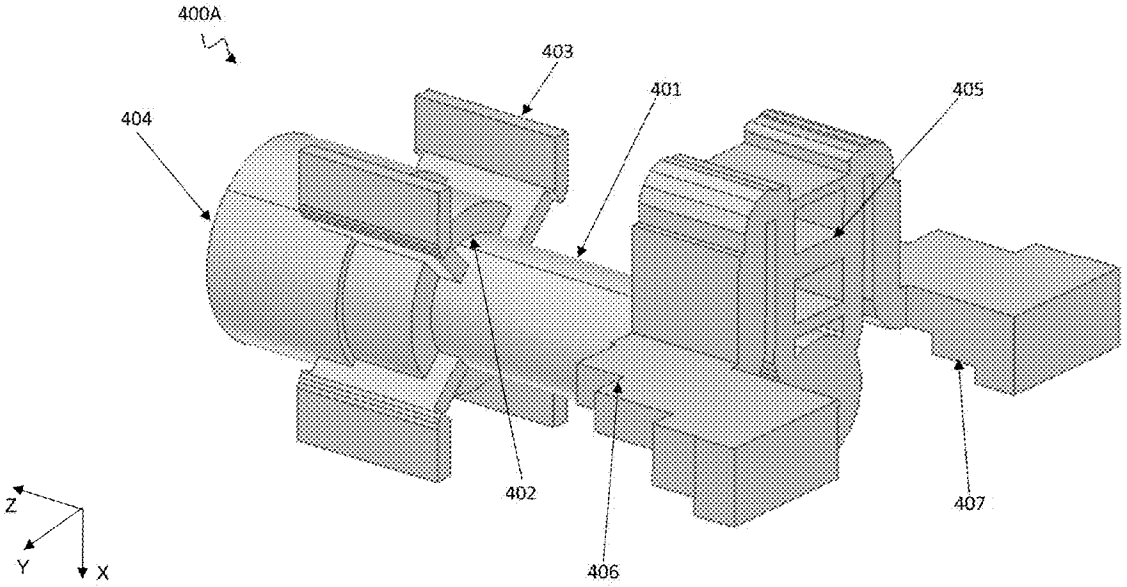
FIG. 4 is a schematic diagram illustrating an air-cavity model of an example multiband circularly polarized waveguide feed network after removal of the TX network, according to certain aspects of the disclosure.

FIG. 4 is a schematic diagram illustrating a perspective view of an air-cavity model 400A of an example multiband circularly polarized waveguide feed network after removal of the TX network, according to certain aspects of the disclosure. Air-cavity model 400A includes a TX-reject filter waveguide 401, a major step 402, a transition region 403, an antenna port 404, an RX branch-line coupler 405, RX Hbends 406, RX waveguide transformer 407. The antenna port 404 is similar to the antenna ports described above, and may provide the RX signal to the RX branch-line coupler 405 via the TX-reject filter waveguide 401. The major step 402 is a step in the TX cutoff and is the beginning part of the TX-reject filter. Transition region 403 is the region where the RX-reject waveguide filters mate up. The RX Hbends 406 are the same as the RX Hbends 385 and 386 of FIGS. 3F and 3G, and the RX waveguide transformer 407 is the same as the RX waveguide transformer 393 and 394 of FIG. 3H.

Figure 5A:
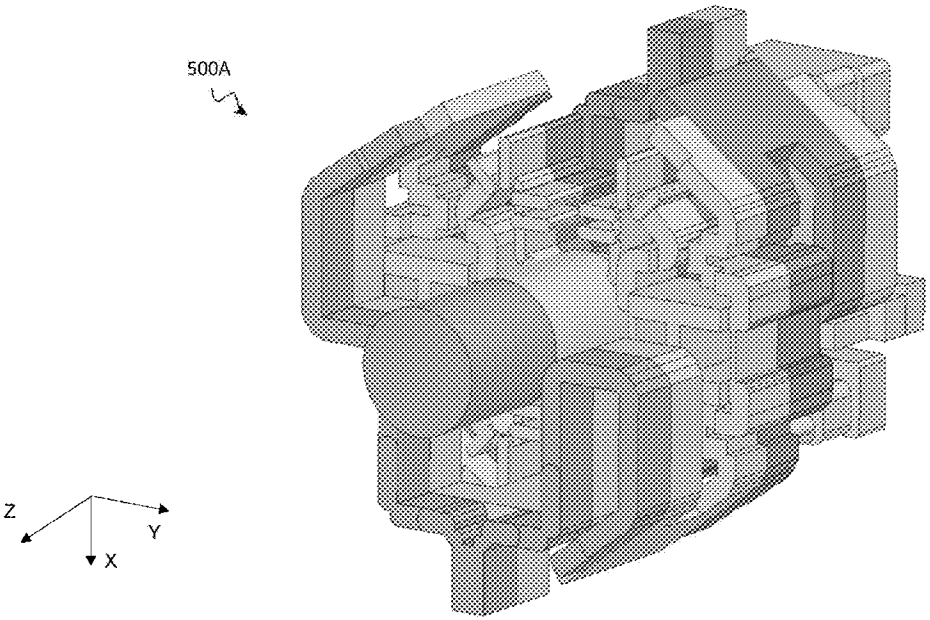
FIGS. 5A and 5B are schematic diagrams illustrating views of air-cavity models of an example multiband circularly polarized waveguide feed network, according to certain aspects of the disclosure.
Figure 5B:
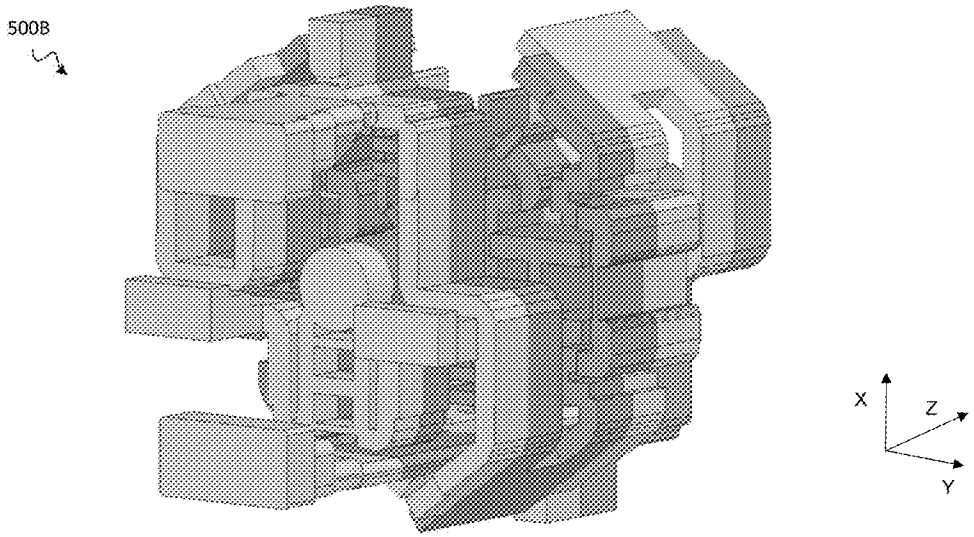

FIGS. 5A and 5B are schematic diagrams illustrating various views of air-cavity models 500A and 500B of an example multiband circularly polarized waveguide feed network, according to certain aspects of the disclosure. The air-cavity model 500A shows the full air-cavity view of the multiband circularly polarized waveguide feed network 100 from the front. The air-cavity model 500B shows the full air-cavity view of the multiband circularly polarized waveguide feed network 100 from the rear.

Figure 6:
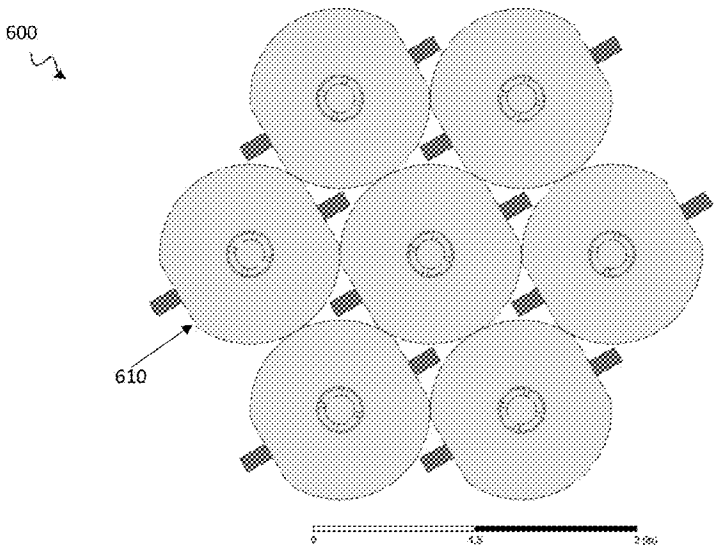
FIG. 6 is a schematic diagram illustrating an example array configuration of multiband circularly polarized waveguide feed networks, according to certain aspects of the disclosure.

FIG. 6 is a schematic diagram illustrating an example array configuration 600 of multiband circularly polarized waveguide feed networks, according to certain aspects of the disclosure. Array configuration 600 includes a number of multiband circularly polarized waveguide feed network elements 610 arranged in multiple rows and columns. The multiband circularly polarized waveguide feed network elements 610 are clocked 45 degrees such that they fit under the smallest Ka-band aperture size. Array configuration 600 can be coupled to an antenna array, where each element of the antenna array (e.g., a horn antenna) is coupled to an antenna port of the multiband circularly polarized waveguide feed network elements 610. As described above, the RX reject filters of the multiband circularly polarized waveguide feed network elements 610 have been folded in such a manner that TX signals can be routed through the entire assembly of the multiband circularly polarized waveguide feed network elements 610 without interference. Additionally, the magic tees may be positioned in the manner described above in the multiband circularly polarized waveguide feed network elements 610 that a loaded difference port of the magic tees may be positioned as a tongue load to the assembly of a multiband circularly polarized waveguide feed network element 610 without negatively impacting the diametrical fit.

Figure 7B:
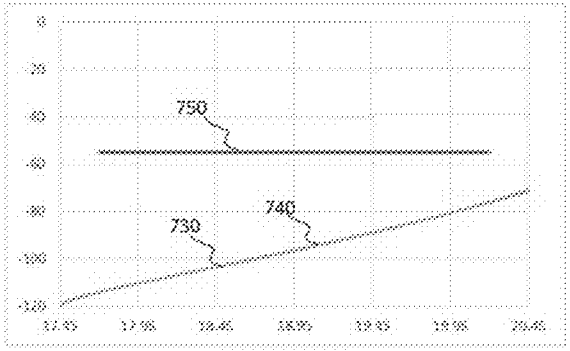
FIGS. 7A, 7B, and 7C are charts illustrating axial-ratio performance, TX-RX isolation performance, and return-loss performance of an example multiband circularly polarized waveguide feed network, according to certain aspects of the disclosure.
Figure 7A:
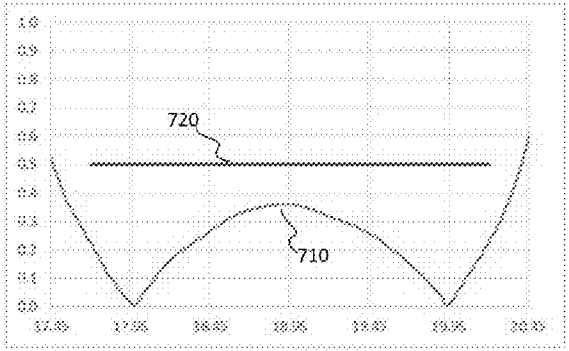
Figure 7C:
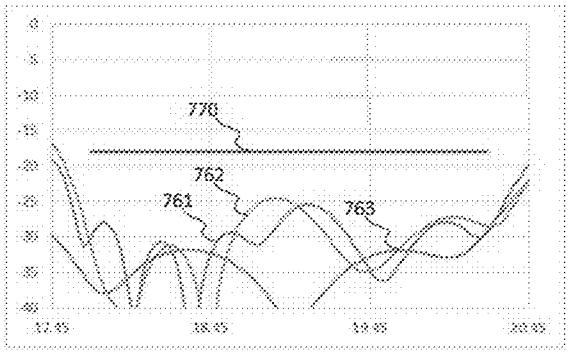
Figure 8B:
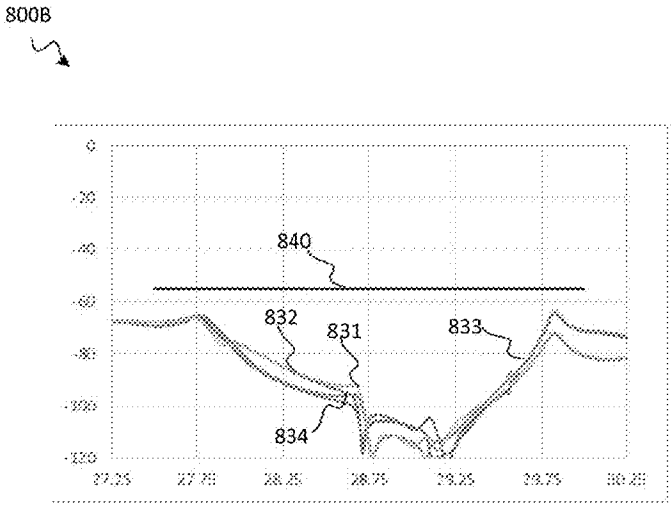
FIGS. 8A, 8B, 8C, and 8D are charts illustrating axial-ratio performance, TX-RX isolation performance, return-loss performance, higher order mode suppression of an example multiband circularly polarized waveguide feed network, according to certain aspects of the disclosure.
Figure 8A:
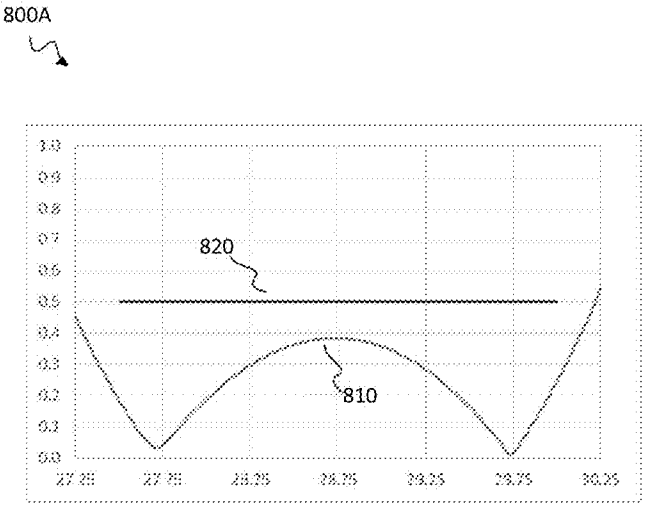
Figure 8D:
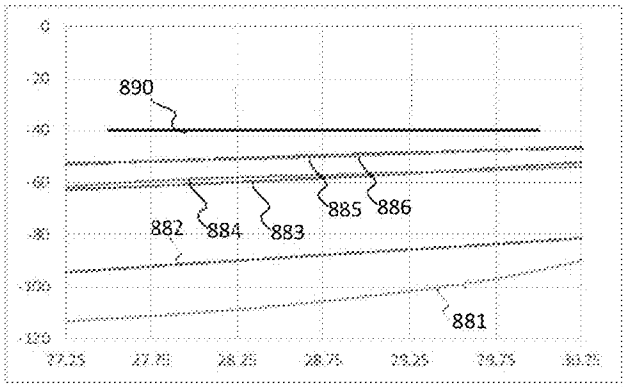
Figure 8C:
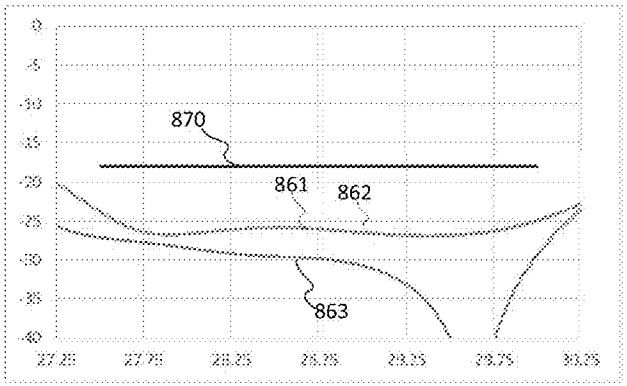

FIGS. 7A, 7B, and 7C are charts 700A, 700B, 700C illustrating axial-ratio performance, TX-RX isolation performance, and return-loss performance of the multiband circularly polarized waveguide feed network according to certain aspects of the disclosure. Chart 700A shows a plot 710 of the variation of TX axial ratios at the above described TX waveguide transformer ports of the multiband circularly polarized waveguide feed network 100. The TX axial ratio values, as depicted by plot 710, are lower than about 0.35 dB and well below a specification limit of about 0.5 dB, as shown by a line 720.

Chart 700B shows plots 730 and 740 (overlapping plots) of the variation of RX-to-TX port isolation between the above described RX waveguide transformer ports and TX waveguide transformer ports of the multiband circularly polarized waveguide feed network 100. The RX-to-TX port isolation values, as depicted by plots 730 and 740, are lower than about −70 dB and well below a specification limit of about −58 dB, as shown by a line 750. Chart 700C shows plots 761 and 762 of the variation of TX return loss at the above described different TX waveguide transformer ports of the multiband circularly polarized waveguide feed network 100. These return-loss values, as depicted by plots 761 and 762, are lower than −25 dB and well below a specification limit of about −18 dB, as shown by a line 770. Chart 700C also shows plot 763 of the variation of the RHCP to LHCP isolation between a RHCP TX waveguide transformer and a LHCP TX waveguide transformer of the multiband circularly polarized waveguide feed network 100 (e.g., between RHCP TX waveguide transformer 391 and LHCP TX waveguide transformer 392). This return-loss value, as depicted by plot 764, is lower than −29 dB and well below a specification limit of about −18 dB, as shown by a line 770.

FIGS. 8A, 8B, 8C, and 8D are charts 800A, 800B, 800C, 800D illustrating axial-ratio performance, TX-RX isolation performance, return-loss performance, higher order mode suppression of the multiband circularly polarized waveguide feed network according to certain aspects of the disclosure. Chart 800A shows a plot 810 of the variation of RX axial ratios at the above described RX waveguide transformer ports of the multiband circularly polarized waveguide feed network 100. The RX axial ratio values, as depicted by plot 810, are lower than about 0.39 dB and well below a specification limit of about 0.5 dB, as shown by a line 820. Chart 800B shows plots 831, 832, 833, and 834 of the variation of TX-to-RX port isolation between the above described TX waveguide transformer ports and RX waveguide transformer ports of the multiband circularly polarized waveguide feed network 100. The TX-to-RX port isolation values, as depicted by plots 831, 832, 833, and 834, are lower than about −65 dB and well below a specification limit of about −58 dB, as shown by a line 840.

Chart 800C shows plots 861 and 862 (overlapping plots) of the variation of RX return loss at the above described different RX waveguide transformer ports of the multiband circularly polarized waveguide feed network 100. These return-loss values, as depicted by plots 861 and 862, are lower than −23 dB and well below a specification limit of about −18 dB, as shown by a line 870. Chart 800C also shows plot 863 of the variation of the RHCP to LHCP isolation between a RHCP RX waveguide transformer and a LHCP RX waveguide transformer of the multiband circularly polarized waveguide feed network 100 (e.g., between RHCP RX waveguide transformer 393 and LHCP RX waveguide transformer 394). This return-loss value, as depicted by plot 863, is lower than −28 dB and well below a specification limit of about −18 dB, as shown by a line 870.

Chart 800D shows plots 881, 882, 883, 884, and 885 and 886 (overlapping plots) of higher order mode suppression for a RX frequency range of 27.5 GHz to 30 GHz. Plot 881 represents higher order mode TE01, plots 882 and 884 represents higher order mode TE21, plot 883 represents higher order mode TM01, and overlapping plots 885 and 886 represent higher order mode TM11. As shown by plots 881, 882, 883, 884, and 885 and 886, the higher order content is less than −45 dB for the multiband circularly polarized waveguide feed network 100. This is below a specification limit of about −40 dB, as shown by the line 890, and does not degrade axial-ratio performance or antenna patterns of the multiband circularly polarized waveguide feed network 100.

Figure 9:
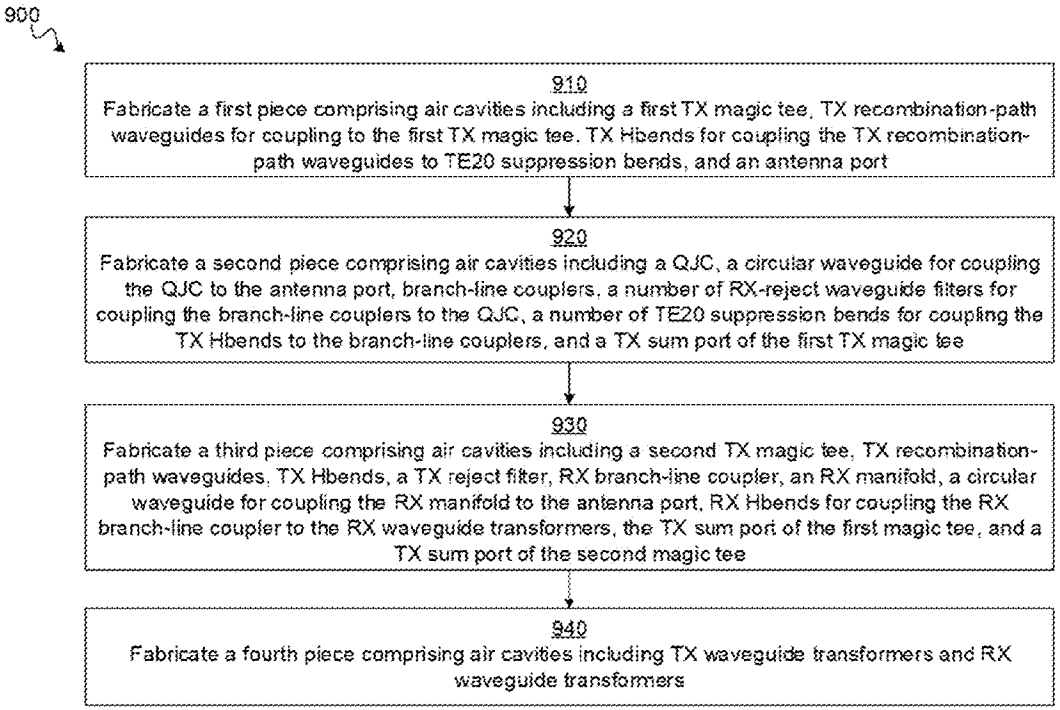
FIG. 9 illustrates a flow diagram of an example process for manufacturing a multiband circularly polarized waveguide feed network, according to certain aspects of the disclosure.

FIG. 9 illustrates a flow diagram of an example process 900 for manufacturing a multiband circularly polarized waveguide feed network, according to certain aspects of the disclosure. For explanatory purposes, the process 900 is primarily described herein with reference to the multiband circularly polarized waveguide feed network 100 of FIG. 1 or 200A of FIG. 2A, and various components described herein with reference to FIGS. 1-6.

The process 900 includes fabricating a first piece (e.g., 300A of FIGS. 3A and 3B) comprising air cavities including a first TX magic tee (e.g., 304 of FIG. 3B), TX recombination-path waveguides (e.g., 303 and 305 of FIG. 3B) for coupling to the first TX magic tee (e.g., for coupling at the co-polar ports of the magic tee), TX Hbends (e.g, 306 and 307 of FIG. 3B) for coupling the TX recombination-path waveguides to TE20 suppression bends (e.g., 351, 352, 353, and 354 of FIGS. 3D and 3E) and an antenna port (e.g., 302 of FIGS. 3A and 3B) (910).

The method further includes fabricating a second piece (e.g., 300B of FIGS. 3C and 3D) comprising air cavities including a QJC (e.g., TX manifold 341 of FIG. 3D), a circular waveguide for coupling the QJC to the antenna port, branch-line couplers (e.g., 331 and 332 of FIG. 3D), a number of RX-reject waveguide filters (e.g., 321, 322, 323, 324 of FIG. 3D) for coupling the branch-line couplers to the QJC, a number of TE20 suppression bends (e.g., 351, 352, 353, and 354 of FIG. 3D) for coupling the TX Hbends to the branch-line couplers, and a TX sum port (e.g., 308 of FIG. 3C) of the first TX magic tee (920).

The method further includes fabricating a third piece (e.g. 300C of FIGS. 3E and 3F) comprising air cavities including a second TX magic tee (e.g., 381 of FIG. 3F), TX recombination-path waveguides (e.g., 382 and 383 of FIG. 3F), TX Hbends (e.g., 361 and 362 of FIG. 3F), a TX reject filter (e.g., 371 of FIG. 3E), RX branch-line coupler (e.g., 384 of FIG. 3F), an RX manifold (e.g., 372 of FIG. 3F), a circular waveguide for coupling the RX manifold to the antenna port, RX Hbends (e.g., 385 and 386 of FIG. 3F) for coupling the RX branch-line coupler to the RX waveguide transformers (e.g., 393 and 394 of FIG. 3H), the TX sum port of the first magic tee, and a TX sum port (e.g., 388 of FIG. 3G) of the second magic tee (930).

The method further includes fabricating a fourth piece (e.g., 300D of FIGS. 3G and 3H) comprising air cavities including TX waveguide transformers (e.g, 391 and 392 of FIG. 3H) and RX waveguide transformers (e.g., 393 and 394 of FIG. 3H) (940). As described above, the first, second, third, and fourth pieces have three zero-current split planes (e.g., 207, 208, and 209).

In some aspects, the subject technology is related to antenna technology, and more particularly to a multiband dual polarization TX, dual polarization RX, circular polarization waveguide network. In some aspects, the subject technology may be used in various markets, including, for example and without limitation, sensor technology, communication systems and radar technology markets.

Those of skill in the art would appreciate that the various illustrative blocks, modules, elements, components, methods, and algorithms described herein may be implemented as electronic hardware, computer software, or combinations of both. To illustrate this interchangeability of hardware and software, various illustrative blocks, modules, elements, components, methods, and algorithms have been described above generally in terms of their functionalities. Whether such functionalities are implemented as hardware or software depends upon the particular application and design constraints imposed on the overall system. Skilled artisans may implement the described functionalities in varying ways for each particular application. Various components and blocks may be arranged differently (e.g., arranged in a different order, or partitioned in a different way), all without departing from the scope of the subject technology.

It is understood that any specific order or hierarchy of blocks in the processes disclosed is an illustration of example approaches. Based upon design preferences, it is understood that the specific order or hierarchy of blocks in the processes may be rearranged, or that all illustrated blocks may be performed. Any of the blocks may be performed simultaneously. In one or more implementations, multitasking and parallel processing may be advantageous. Moreover, the separation of various system components in the embodiments described above should not be understood as requiring such separation in all embodiments, and it should be understood that the described program components and systems can generally be integrated together in a single hardware and software product or packaged into multiple hardware and software products.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

A reference to an element in the singular is not intended to mean "one and only one" unless specifically stated, but rather "one or more." The term "some" refers to one or more. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined, or modified and all such variations are considered within the scope and spirit of the present invention. While compositions and methods are described in terms of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range are specifically disclosed. Also, the terms in the claims have their plain, ordinary meanings unless otherwise explicitly and clearly defined by the patentee. If there is any conflict in the usage of a word or term in this specification and one or more patent or other documents that may be incorporated herein by reference, the definition that is consistent with this specification should be adopted.

What is claimed is:

1. A multiband waveguide feed network comprising:

a plurality of transmit (TX) magic tees;

a plurality of receive (RX)-reject waveguide filters configured to reject RX frequencies;

a plurality of branch-line couplers that couple the plurality of RX-reject waveguide filters to the plurality of TX magic tees; and a quadrature junction coupler that couples the plurality of RX-reject waveguide filters to an antenna port, wherein:

the multiband waveguide feed network is formed by four pieces with three split planes, and the multiband waveguide feed network is circularly polarized;

the plurality of TX magic tees comprise a first TX magic tree (TX tree 1) and a second TX magic tree (TX tree 2), wherein each of the TX tree 1 and TX tree 2 comprises multiple ports;

the plurality of branch-line couplers comprise a first branch-line coupler (branch 1) and a second branch-line coupler (branch 2), wherein each of the branch 1 and the branch 2 comprises multiple input ports and multiple output ports;

with respect to the TX tree 1, a first one of the multiple ports of the TX tree 1 (TX1-port1) is coupled to a first one of the multiple input ports of the branch 1 (branch1-input1), and a second one of the multiple ports of the TX tree 1 (TX1-port2) is coupled to a first one of the multiple input ports of the branch 2 (branch2-input1);

with respect to the TX tree 2, a first one of the multiple ports of the TX tree 2 (TX2-port1) is coupled to a second one of the multiple input ports of the branch 1 (branch1-input2); and a second one of the multiple ports of the TX tree 2 (TX2-port2) is coupled to a second one of the multiple input ports of the branch 2 (branch2-input2);

the plurality of RX-reject waveguide filters comprise a first RX-reject waveguide filter (Rx-reject filter 1), a second RX-reject waveguide filter (Rx-reject filter 2), a third RX-reject waveguide filter (Rx-reject filter 3) and a fourth RX-reject waveguide filter (Rx-reject filter 4);

with respect to the branch 1, a first one of the multiple output ports of the branch 1 is coupled to the Rx-reject filter 1, and a second one of the multiple output ports of the branch 1 is coupled to the Rx-reject filter 2;

with respect to the branch 2, a first one of the multiple output ports of the branch 2 is coupled to the Rx-reject filter 3, and a second one of the multiple output ports of the branch 2 is coupled to the Rx-reject filter 4;

both the Tx trees 1 and 1 are configured to use the branches 1 and 2 and the Rx-reject filters 1, 2, 3 and 4 for TX signal transmission;

the quadrature junction coupler is different from the plurality of branch-line couplers;

the multiband waveguide feed network is configured to pass a first TX signal (TX signal 1) from the TX tree 1, to the TX1-port1 and the TX1-port2 in parallel, then to the branch1-input1 and the branch2-input1 in parallel, then to the branches 1 and 2 in parallel, and then to the Rx-reject filters 1, 2, 3 and 4 in parallel; and the multiband waveguide feed network is configured to pass a second TX signal (TX signal 2) from the TX tree 2, to the TX2-port1 and the TX2-port2 in parallel, then to the branch1-input2 and the branch2-input2 in parallel, then to the branches 1 and 2 in parallel, and then to the Rx-reject filters 1, 2, 3 and 4 in parallel.

2. The multiband waveguide feed network of claim 1, wherein the first TX magic tee of the plurality of TX magic tees is implemented as a first portion and a second portion in a first piece and a second piece of the four pieces, respectively.

3. The multiband waveguide feed network of claim 2, wherein the first piece and the second piece are connected via a first split plane of the three split planes.

4. The multiband waveguide feed network of claim 3, wherein the first split plane is on zero-current region of the multiband waveguide feed network.

5. The multiband waveguide feed network of claim 1, further comprising a plurality of TX recombination-path waveguides configured to couple the plurality of branch-line couplers to the plurality of TX magic tees.

6. The multiband waveguide feed network of claim 5, wherein a first pair of the plurality of TX recombination-path waveguides are identical in phase length to each other.

7. The multiband waveguide feed network of claim 6, wherein the each of the first pair of TX recombination-path waveguides are clocked differently from each other.

8. The multiband waveguide feed network of claim 1, wherein each of the plurality of RX-reject waveguide filters are implemented as a first portion and a second portion in a second piece and a third piece of the four pieces, respectively.

9. The multiband waveguide feed network of claim 1, comprising a plurality of transition waveguides coupling the plurality of branch-line couplers to the plurality of RX-reject waveguide filters.

10. The multiband waveguide feed network of claim 1, wherein a first piece of the four pieces is coupled to the antenna port.

11. The multiband waveguide feed network of claim 10, further comprising a plurality of TX ports implemented in a fourth piece of the four pieces, wherein a first TX port of the plurality of TX ports is coupled to the first TX magic tee of the plurality of TX magic tees and a second TX port of the plurality of TX ports is coupled to the second TX magic tee of the plurality of TX magic tees.

12. The multiband waveguide feed network of claim 11, further comprising an RX network implemented in a first portion and a second portion in a third piece and a fourth piece of the four pieces, respectively.

13. The multiband waveguide feed network of claim 1, wherein the four pieces are fabricated using at least one of machining, electroplating, or three-dimensional (3D) printing.

14. The multiband waveguide feed network of claim 1, wherein:

the multiband waveguide feed network comprises a TX network and an RX network;

the TX network comprises the Tx trees 1 and 2, the branches 1 and 2, and the Rx-reject filters 1, 2, 3 and 4;

the RX network comprises a TX-reject waveguide filter (Tx-reject filter) and an RX branch-line coupler (RX branch);

the Tx-reject filter is configured to reject TX frequencies;

the TX frequencies are lower than the RX frequencies;

with respect to the TX network, the branches 1 and 2 and the Rx-reject filters 1, 2, 3 and 4 are configured to be shared by the TX signal 1 and the TX signal 2;

the TX network is configured to pass the TX signal 1 from the TX tree 1, to the TX1-port1 and the TX1-port2, to the branch1-input1 and the branch2-input1, to the branches 1 and 2, and then to the Rx-reject filters 1, 2, 3 and 4, without using the RX network;

the TX network is configured to pass the TX signal 2 from the TX tree 2, to the TX2-port1 and the TX2-port2, to the branch1-input2 and the branch2-input2, to the branches 1 and 2, and then to the Rx-reject filters 1, 2, 3 and 4, without using the RX network;

the multiband waveguide feed network is configured to pass the TX signal 1 and the TX signal 2 from the Rx-reject filters 1, 2, 3 and 4 to the antenna port for transmission;

the multiband waveguide feed network is configured to receive an RX signal from the antenna port and pass the RX signal to the Tx-reject filter; and the RX network is configured to pass the RX signal from the Tx-reject filter to the RX branch without using the TX network.

15. An antenna array system comprising:

an antenna array comprising a plurality of antenna elements;

an array of multiband waveguide feed networks comprising a plurality of multiband waveguide feed networks, each coupled to an antenna element of the antenna array and comprising:

a plurality of transmit (TX) magic tees;

a plurality of receive (RX)-reject waveguide filters configured to reject RX frequencies;

a plurality of branch-line couplers that couple the plurality of RX-reject waveguide filters to the plurality of TX magic tees; and a quadrature junction coupler that couples the plurality of RX-reject waveguide filters to an antenna port, wherein:

each of the plurality of multiband waveguide feed networks is formed by four pieces with three split planes, and the multiband waveguide feed network is circularly polarized;

the plurality of TX magic tees comprise a first TX magic tree (TX tree 1) and a second TX magic tree (TX tree 2), wherein each of the TX tree 1 and TX tree 2 comprises multiple ports;

the plurality of branch-line couplers comprise a first branch-line coupler (branch 1) and a second branch-line coupler (branch 2), wherein each of the branch 1 and the branch 2 comprises multiple input ports and multiple output ports;

with respect to the TX tree 1, a first one of the multiple ports of the TX tree 1 (TX1-port1) is coupled to a first one of the multiple input ports of the branch 1 (branch1-input1), and a second one of the multiple ports of the TX tree 1 (TX1-port2) is coupled to a first one of the multiple input ports of the branch 2 (branch2-input1);

with respect to the TX tree 2, a first one of the multiple ports of the TX tree 2 (TX2-port1) is coupled to a second one of the multiple input ports of the branch 1 (branch1-input2); and a second one of the multiple ports of the TX tree 2 (TX2-port2) is coupled to a second one of the multiple input ports of the branch 2 (branch2-input2);

the plurality of RX-reject waveguide filters comprise a first RX-reject waveguide filter (Rx-reject filter 1), a second RX-reject waveguide filter (Rx-reject filter 2), a third RX-reject waveguide filter (Rx-reject filter 3) and a fourth RX-reject waveguide filter (Rx-reject filter 4);

with respect to the branch 1, a first one of the multiple output ports of the branch 1 is coupled to the Rx-reject filter 1, and a second one of the multiple output ports of the branch 1 is coupled to the Rx-reject filter 2;

with respect to the branch 2, a first one of the multiple output ports of the branch 2 is coupled to the Rx-reject filter 3, and a second one of the multiple output ports of the branch 2 is coupled to the Rx-reject filter 4;

both the Tx trees 1 and 1 are configured to use the branches 1 and 2 and the Rx-reject filters 1, 2, 3 and 4 for TX signal transmission;

the quadrature junction coupler is different from the plurality of branch-line couplers;

the multiband waveguide feed network is configured to pass a first TX signal (TX signal 1) from the TX tree 1, to the TX1-port1 and the TX1-port2 in parallel, then to the branch1-input1 and the branch2-input1 in parallel, then to the branches 1 and 2 in parallel, and then to the Rx-reject filters 1, 2, 3 and 4 in parallel; and the multiband waveguide feed network is configured to pass a second TX signal (TX signal 2) from the TX tree 2, to the TX2-port1 and the TX2-port2 in parallel, then to the branch1-input2 and the branch2-input2 in parallel, then to the branches 1 and 2 in parallel, and then to the Rx-reject filters 1, 2, 3 and 4 in parallel.

16. The antenna array system of claim 15, wherein each multiband waveguide feed network further comprises a plurality of TX recombination-path waveguides configured to couple the plurality of branch-line couplers to the plurality of TX magic tees.

17. The antenna array system of claim 16, wherein each of the plurality of RX-reject waveguide filters are implemented as a first portion and a second portion in a second piece and a third piece of the four pieces, respectively.

18. A method of manufacturing a polarization waveguide network, the method comprising:

fabricating a first piece having a first set of two opposite sides including a first side and a second side, the first piece comprising first air cavities including a first portion of two TX ports of a first transmit (TX) magic tee, TX recombination-path waveguides for coupling to the two TX ports of the first TX magic tee, TX Hbends for coupling the TX recombination-path waveguides to TE20 suppression bends, and an antenna port, wherein the first portion of the two TX ports of the first TX magic tee is on the second side of the first piece;

fabricating a second piece having a second set of two opposite sides including a third side and a fourth side, the second piece comprising second air cavities including a second portion of the two TX ports of the first TX magic tee a quadrature junction coupler (QJC), a circular waveguide for coupling the QJC to the antenna port, a first portion of branch-line couplers, a first portion of receive (RX)-reject waveguide filters for coupling the first portion of the branch-line couplers to the QJC, the TE20 suppression bends for coupling the TX Hbends to the branch-line couplers, and a first portion of TX sum port of the first TX magic tee, wherein the second portion of the two TX ports of the first TX magic tee is disposed on the third side, and wherein the first portion of the branch-line couplers and the first portion of the RX-reject waveguide filters are disposed on the fourth side;

fabricating a third piece comprising having a third set of two opposite sides including a fifth side and a sixth side, the third piece comprising third air cavities including a second portion of the branch-line couplers, a second portion of the RX-reject waveguide filters, a first portion of two TX ports of a second TX magic tee, TX recombination-path waveguides, TX Hbends, a TX reject filter, an RX branch-line coupler, an RX manifold, a circular waveguide for coupling the RX manifold to the antenna port, RX Hbends for coupling the RX branch-line coupler to RX waveguide transformers, and a second portion of the TX sum port of the first TX magic tee;

fabricating a fourth piece comprising having a fourth set of two opposite sides including a seventh side and an eighth side, the fourth piece comprising fourth air cavities including TX waveguide transformers and the RX waveguide transformers; and assembling the first, second, third and fourth pieces in series so that the second side mates with the third side, the fourth side mates with the fifth side, and the sixth side mates with the seventh side, wherein the two TX ports of the first TX magic tee and the two TX ports of the second TX magic tee are coupled to the branch-line couplers in parallel, and the branch-line couplers are coupled to the RX-reject waveguide filters in parallel, to enable a first TX signal to pass from the first TX magic tee, to the branch-line couplers in parallel, and then to the RX-reject waveguide filters in parallel, and to enable a second TX signal to pass from the second TX magic tee, to the branch-line couplers in parallel, and then to the RX-reject waveguide filters in parallel.

19. The method of claim 18, wherein the fabricating of the first piece, the second piece, the third piece, and the fourth piece is performed using at least one of machining, electroplating or three-dimensional (3-D) printing, and wherein the first piece, the second piece, the third piece, and the fourth piece have three zero-current split planes.

20. The method of claim 18, wherein the second portion of the branch-line couplers and the second portion of the RX-reject waveguide filters are disposed on the fifth side, and wherein the first portion of the two TX ports of the second TX magic tee is disposed on the sixth side.

* * * * *